US012207752B1

(12) United States Patent
LeCompte et al.

(10) Patent No.: US 12,207,752 B1
(45) Date of Patent: Jan. 28, 2025

(54) SNAP FASTENER WITH HOOK

(71) Applicant: YKK Corporation of America, Atlanta, GA (US)

(72) Inventors: Chuck LeCompte, Frankfort, KY (US); Jonathan Sharp, Lawrenceburg, KY (US); Kathryn Sullivan, Frankfort, KY (US)

(73) Assignee: YKK Corporation of America, Atlanta, GA (US)

( * ) Notice: Subject to any disclaimer, the term of this patent is extended or adjusted under 35 U.S.C. 154(b) by 0 days.

(21) Appl. No.: 18/384,684

(22) Filed: Oct. 27, 2023

(51) Int. Cl.
*A44B 17/00* (2006.01)
*A47H 23/04* (2006.01)

(52) U.S. Cl.
CPC ..... *A47H 23/04* (2013.01); *A44B 17/0041* (2013.01); *A47H 2201/00* (2013.01)

(58) Field of Classification Search
CPC .... A47H 13/04; A47H 2201/00; Y10T 24/51; Y10T 24/3496; A44B 117/0041; A44B 17/0041
See application file for complete search history.

(56) References Cited

U.S. PATENT DOCUMENTS 3,118,207 A * 1/1964 Breslow ..... A47H 13/00 24/304
3,235,926 A * 2/1966 Mates ..... A47H 1/00 24/306
3,437,127 A * 4/1969 Lukashok ..... A47H 23/02 160/348
5,769,144 A * 6/1998 Carter ..... A44B 13/0076 411/338
6,698,061 B2 * 3/2004 Ho ..... A47K 3/38 16/87.8
9,788,675 B1 * 10/2017 Hodgdon ..... A47K 3/38
2008/0283202 A1 11/2008 Serio, III et al.

OTHER PUBLICATIONS

Cube Care Company, Inc.; Article entitled: "Cubicle Curtains With Mesh "It's a Snap" Curtains", located at <https://www.cubecare.com/products/cubicle-curtains-privacy/its-a-snap/>, accessed on Sep. 22, 2023, 24 pgs.
Cubicle Curtain Factory; Article entitled: "Simply 66® Snap Cubicle Curtain System", located at <https://www.cubiclecurtainfactory.com/simply-66-snap-system-cubicle-curtains>, accessed on Sep. 22, 2023, 5 pgs.
Hospital Curtain Solutions, Inc.; Article entitled: "Hospital Curtain Solutions", located at <https://www.hospitalcurtainsolutions.com/snap.html>, accessed on Sep. 22, 2023, 3 pgs.
OCELCO; Article entitled: "EZE Swap Snap On Hospital Curtain System", located at <https://www.ocelco.com/store/pc/home.asp>, accessed on Sep. 22, 2023, 2 pgs.
YKK (U.S.A.), Inc.; Catalog for YKK (U.S.A.), Inc. Snap and Button Products, available prior to Oct. 27, 2022, 16 pgs.

* cited by examiner

*Primary Examiner* — Robert Sandy
(74) *Attorney, Agent, or Firm* — Taylor English Duma LLP

(57) ABSTRACT

A snap member of a fastener includes a base; a first engagement portion extending from the base and configured to engage with a first engagement portion of a mating snap member, the first engagement portion of the snap member including a protrusion defining an axial height, the first engagement portion of the snap member defining a cavity in the protrusion defining an axial depth, an axis of the protrusion and an axis of the cavity being collinear; and a second engagement portion extending from the base, the second engagement portion defining a hook shape.

25 Claims, 8 Drawing Sheets

SNAP FASTENER WITH HOOK

TECHNICAL FIELD

Field of Use

This disclosure relates to snap fasteners. More specifically, this disclosure relates to snap fasteners with hooks that can be used to removably hang objects, e.g., privacy curtains in a health care setting.

Related Art

Privacy curtains or "cubicle curtains" can be used to divide areas and/or provide privacy, especially in healthcare facilities such as, for example and without limitation, hospitals, clinics, or nursing homes. Fire codes can require that an upper section of each privacy curtain to be made of or comprise a mesh material, called the "top mesh." During a fire, the top mesh can allow passage of water from sprinkler heads, usually mounted on a ceiling, to any part of the room without the curtain being a significant obstacle. A lower section of the curtains can comprise an opaque or solid material.

The privacy curtain and, more specifically, at least the upper section thereof can be manually hung on carriers, which typically slide through or along a channel or track that is permanently attached to a ceiling. In hospital and other patient-care facilities, the ceilings can be eight to nine feet from floor to ceiling. A facility's personnel cannot easily reach such heights without using a ladder or power lift-not only during initial installation of the carriers and the curtains but also during regular removal of the curtains for cleaning and/or repair. Even where personnel can remove and reattach the lower section from the upper section where for example the lower section is secured to the upper section with fasteners (e.g., snap fasteners), such removal and reattachment can require two hands and the breaking or reengagement of a mechanical joint and can require the user to somehow, directly or indirectly, access both sides of the curtain, which can itself be difficult.

More generally, separate removably engageable components of a multi-piece fastener such as a snap fastener are typically configured for engagement with each other-in the process, typically joining two structural components to each other (e.g., two pieces of fabric in a clothing garment or a vehicle cover to a boat), but the fastener itself typically does not include functionality beyond such engagement of such components with each other.

SUMMARY

It is to be understood that this summary is not an extensive overview of the disclosure.

This summary is exemplary and not restrictive and is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a snap member of a fastener, the snap member comprising: a base; a first engagement portion extending from the base and configured to engage with a first engagement portion of a mating snap member, the first engagement portion of the snap member comprising a protrusion defining an axial height, the first engagement portion of the snap member defining a cavity in the protrusion defining an axial depth, an axis of the protrusion and an axis of the cavity being collinear; and a second engagement portion extending from the base, the second engagement portion defining a hook shape.

In a further aspect, disclosed is a curtain comprising: at least one of an upper panel and a lower panel; and a snap member, the snap member configured to engage with the at least one of an upper panel and a lower panel.

In yet another aspect, disclosed is a method of using a snap member, the method comprising: removably securing a first engagement portion of the snap member to a first object; and removably receiving a second engagement portion of the snap member within an opening defined in a second object, the second engagement portion defining a hook shape.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and, together with the description, explain various principles of the disclosure. The drawings are not necessarily drawn to scale. Corresponding features and components throughout the figures may be designated by matching reference characters for the sake of consistency and clarity.

DETAILED DESCRIPTION

Figure 1:
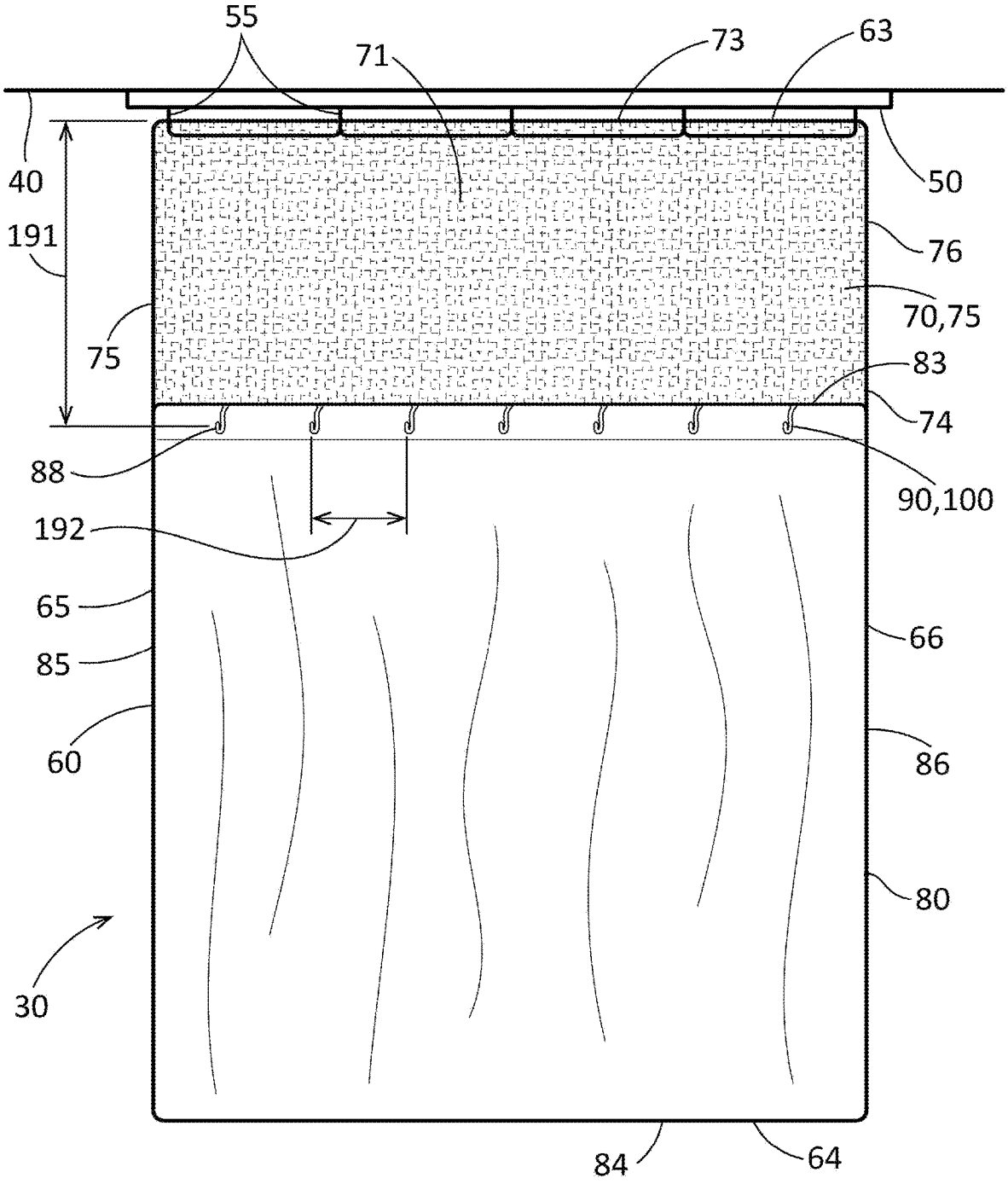
FIG. 1 is a front elevation view of a curtain suspended from a track in accordance with one aspect of the current disclosure, the curtain comprising an upper section and a lower section removably secured to and suspended from the upper section via a plurality of fasteners secured to the upper section.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an," and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes, and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

As used herein, unless the context clearly dictates otherwise, the term "monolithic" in the description of a component means that the component is formed as a singular component that constitutes a single material without joints or seams. Unless otherwise specified herein, any structure disclosed in the drawings or in the written description as being so formed can be monolithic whether or not such an explicit description of the structure is included herein.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that side of the curtain and that end of the fastener nearest to and occupied by a snap member of the fastener and, more specifically, a second engagement portion (e.g., a hook portion) of the snap member; "rear" is that side of the curtain and end of the fastener that is opposite or distal the front; "left" is that which is to the left of or facing left from a person facing towards the front; and "right" is that which is to the right of or facing right from that same person facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

Figure 2:
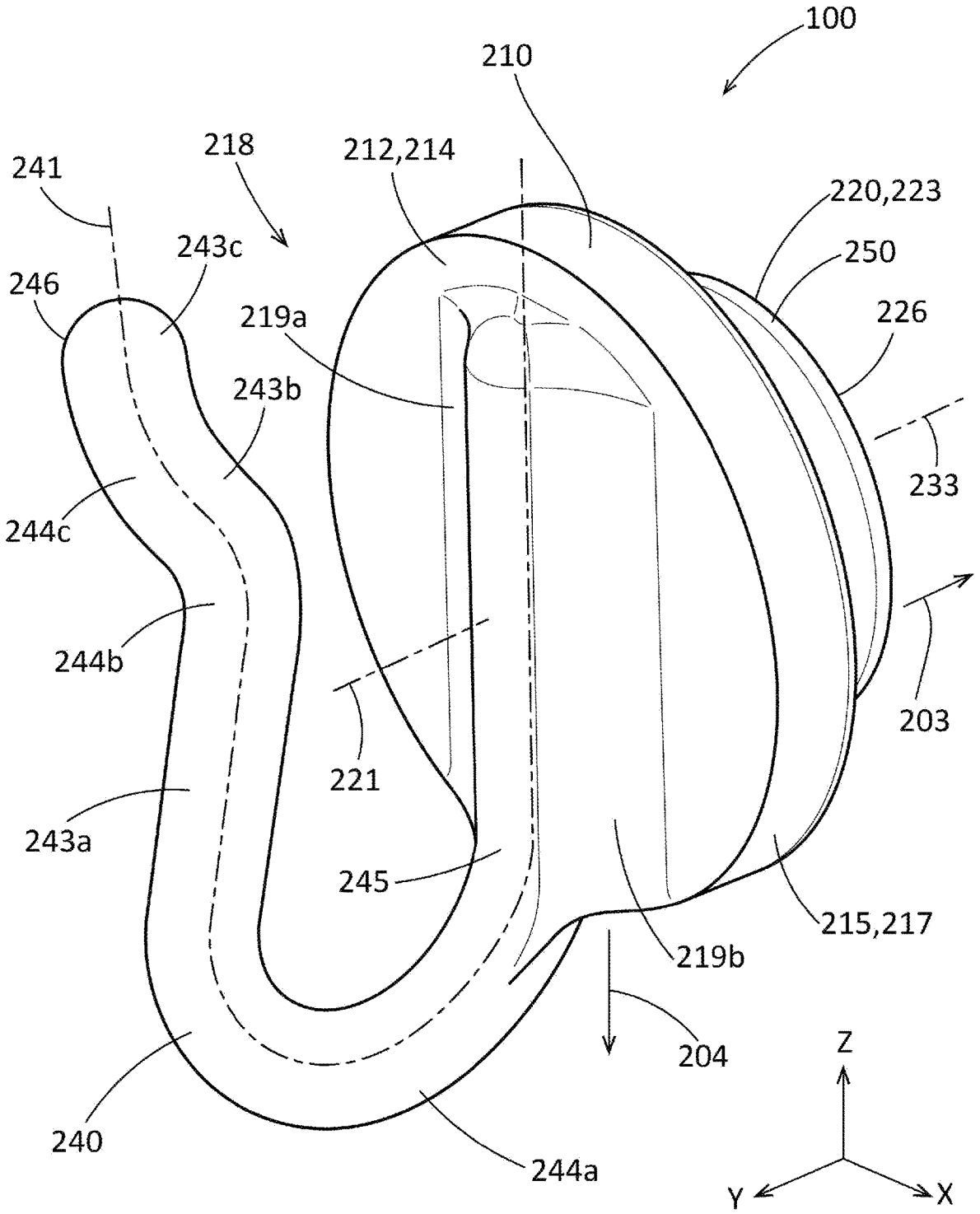
FIG. 2 is a top front perspective view of a first portion or snap member of the fastener of FIG. 1.

The fastener can also be described using a coordinate axis of X-Y-Z directions shown in FIG. 2. An X-axis direction can be referred to as a left-right or horizontal direction. An upper-lower direction is a Z-axis direction orthogonal to the X-axis direction and to a Y-axis direction. The Y-axis direction is orthogonal to the X-axis direction (left-right direction) and the Z-axis direction (upper-lower direction) and can also be referred to as a front-rear direction. A surface of a structural element that is parallel with the front-rear direction can be referred to as a lateral side.

In one aspect, a first portion or snap member and associated methods, systems, devices, and various apparatuses are disclosed herein. In one aspect, the snap member can comprise a second engagement portion or hook portion.

The aforementioned curtains can be any suitable width and any suitable length. Because the curtains can in some cases be long enough or tall enough to extend from a floor to a ceiling of a room (e.g., as much as 96" long or longer in finished length) and can be wide enough to extend across the room or circumscribe an area, the curtain can be heavy and bulky to move and hang, even if split into multiple pieces. When the curtain is split into an upper section and a lower section, a point of connection between the upper section and the lower section can be seven to eight feet off the ground or floor.

Cleaning of the curtain can be done as often as weekly or whenever a patient is discharged from an area enclosed by the curtain. Facility standards and/or patient needs can require that if any portion of the curtain is stained, especially with human or chemical fluids, it must be removed and cleaned, which is usually if not always done in a separate location. Facility standards and/or patient needs can require that, in such case, a replacement curtain be hung when the original curtain is removed. The cleaning itself can be and usually is performed using industrial cleaning equipment and cleaning chemicals. Furthermore, any fasteners permanently attached to the curtain, especially any portion that is more frequently cleaned, can degrade over time due to exposure to such equipment and chemicals and can result in more frequent—and, thus, more costly—repair and/or replacement of the curtains. Furthermore, permanent attachment of fasteners to the curtain can result in a higher cost to manufacture the curtain originally—including higher manufacturing equipment, higher material cost, and higher labor cost—versus a curtain or portion thereof requiring no fasteners.

FIG. 1 is front elevation view of an object 60 in accordance with one aspect of the current disclosure. The object 60, which can be a curtain, can be suspended from a track 50, which can be secured to a ceiling 40 of an interior space such as, for example and without limitation, a room in a hospital, clinic, or nursing home. More specifically, the track 50 can comprise one or more carriers 55. The curtain 60 can comprise an upper section or upper panel 70. The upper section 70 of each privacy curtain can be made of or can comprise a netting or mesh material 71.

The curtain 60 can further comprise a lower section or lower panel 80, which can be removably secured to and suspended from the upper section 70. The lower section 80 can be secured to the upper section 70 via one or more fasteners 90. More specifically, each of or any of the one or more fasteners 90 can be removably secured to the upper section 70. In some aspects, as shown, a plurality of the fasteners 90 can be aligned horizontally. Each of the plurality of the fasteners 90 and, more specifically, a center or axis thereof can be positioned a first spacing distance or first spacing or vertical spacing 191 from a horizontal edge of the upper section 70. In some aspects, as also shown, each pair of adjacent fasteners 90 of the plurality of the fasteners 90 and, more specifically, centers or axes thereof can be spaced apart by a second spacing distance or second spacing or horizontal spacing 192. Two or more of the curtain 60, the fasteners 90, and other structural elements or portions of any of the structural elements disclosed herein can together form a system 30.

The curtain 60 can define a top end 63, a bottom end 64, a first side end 65, and a second side end 66. The upper section 70 of the curtain 60 can define a top end 73, a bottom end 74, a first side end 75, and a second side end 76. The lower section 80 of the curtain 60 can define a top end 83, a bottom end 84, a first side end 85, and a second side end 86. As shown, the top end 83 of the lower section 80 can be secured to the bottom end 74 of the upper section 70. In some aspects, as shown, each of the upper section 70 and the lower section 80 can define or comprise a single, one-piece panel. In some aspects, each of the upper section 70 and the lower section 80 can define a plurality of panels, which can be lined up side-by-side, with or without overlap as may be desired or required by a particular end-use. Where the panels of the upper section 70 and/or the lower section 80 are divided, one or more fasteners 90 can support adjacent (e.g., side-by-side) panels so as to facilitate such overlapping arrangement. More specifically, the one or more fasteners 90 can be removably inserted in one of a plurality of openings 88 defined in the lower section 80, which openings 88 can be spaced apart by the second spacing 192 or spacing that is greater than or less than the second spacing 192.

Each of or any of the plurality of fasteners 90 can be a snap fastener. Each of or any of the one or more fasteners 90 can comprise a first portion or snap member 100 and a second portion or mating snap member 700 (shown in FIG. 7).

FIG. 2 is a top front perspective view of the first portion or snap member 100 of one of the plurality of fasteners 90 of FIG. 1. The snap member 100 can comprise a base 210. The base 210 can define a first side 211 (shown in FIG. 3), which can define a first side surface 213 (shown in FIG. 3). The base 210 can define a second side 212, which can define a second side surface 214. The base 210 can define an outer edge 215, which can define an outer edge surface 217 and can be cylindrical or substantially cylindrical in shape ("substantially cylindrical" meaning having an overall shape that is cylindrical, ignoring local interruptions to that overall shape that do no extend around the full circumference of the outer edge 215 as well as draft angles of five degrees or less that facilitate manufacturability of the snap member 100). In some aspects, as shown, the base 210 can define a disc shape. More specifically, the base 210 can define a circular shape in cross-section and, more specifically, in radial cross-section, where a radial cross-section lies in a viewing plane that is perpendicular to an axis 221 of the snap member 100. In some aspects, the base 210 can define a non-disc shape or a non-circular shape in cross-section and, more specifically, in radial cross-section.

The snap member 100 can comprise a first engagement portion 220, which can extend from the base 210 in a first direction 203. The first direction 203 can be aligned with the axis 221 of the snap member 100. More specifically, the snap member 100 can be configured to engage with a mating engagement portion or first engagement portion 720 (shown in FIG. 7) of the mating snap member 700 (shown in FIG. 7). The first engagement portion 220 can comprise a protrusion 223, which can define a proximal or first end 225 (shown in FIG. 3) and a distal or second end 226. More specifically, the protrusion 223 can define an axial height 227 (shown in FIG. 6). The first engagement portion 220 can define a cavity 228 (shown in FIG. 3), which can be defined in the protrusion 223. More specifically, the cavity 228 can define an axial depth 229 (shown in FIG. 6). An axis 233 of the protrusion 223 and an axis 238 of the cavity 228 can be collinear. In some aspects, the first engagement portion 220 can define rotational symmetry about the axis 221. At least a portion of the first side 211 and, more specifically, the first side surface 213 can be planar.

Defined in further detail below, an outer diameter 627 (shown in FIG. 6) of the first engagement portion 220 at the second end 226 can be larger than at the first end 225. In some aspects, a maximum value of the outer diameter 627 of the first engagement portion 220 can be configured to decrease during assembly of the first engagement portion 220 with the first engagement portion 720 of the mating snap member 700 to allow and facilitate insertion in and locking engagement of the first engagement portion 220 with the first engagement portion 720. As shown, the first engagement portion 220 can define one or more bulbous tips or ribs 250 at the second end 226, which can further facilitate locking engagement of the first engagement portion 220 with the first engagement portion 720.

The snap member 100 can comprise a second engagement portion or hook portion 240, a portion of which can extend from the base 210 in a second direction 204. In some aspects, as shown, the second direction 204 can be angled with respect to the axis 221 of the snap member 100 and/or the first direction 203. In some aspects, the second direction 204 can be aligned with the axis 221 of the snap member 100 and/or the first direction 203. The second engagement portion 240 can define a proximal or first end 245 and a distal or second end 246, which can define a radius or, more specifically, a full spherical radius to ease insertion of the second end 246 through the opening 88. The second engagement portion 240 can comprise a hook or hook member and can define a hook shape, which can include any shape that an object such as, for example and without limitation, the lower section 70 (shown in FIG. 1) of the curtain 60 (shown in FIG. 1) can hang or catch on. In some aspects, the object 60 need not be a curtain per se and can be or can comprise bird netting, insect netting, a tarpaulin or tarp, or any other panel. In some aspects, the object 60 and, more specifically, the curtain 60 can be flexible and can comprise a flexible material that is configured to be folded or bunched up when not fully deployed or extended. In some aspects, the curtain 60 can be comprise a fabric material. In some aspects, the curtain 60 can be comprise a polymer material. The snap member 100 and one or more portions thereof such as the base 210 and the second engagement portion 240 can define a space or gap 218 therebetween for passage of a portion of an object such as a top end 83 of the curtain 60. The gap 218 can be made more open to ease disengagement and removal of the lower section 80. The gap 218 can be made tighter to make disengagement and removal of the lower section 80 more difficult, which can help avoid accidental or unauthorized removal of the curtain 60 and, more specifically, the lower section 80. In some aspects, as shown, the second engagement portion 240 can define a tangent line or axis 241. As also shown, the second engagement portion 240 can define one or more straight portions (e.g., a straight portions 243*a,b,c*) and/or one or more curved portions (e.g., curved portions 244*a,b,c*). The presence of the one or more curved portions can facilitate bending of the second engagement portion 240 without exceeding the yield strength of a material forming the second engagement portion 240 (for example only, by reducing stress concentrations resulting from sharp or immediate turns between two adjoining portions such as two adjoining straight portions). Similarly, one or more transition portions 219*a,b* between the base 210 and the second engagement portion 240 can define a radius R219 (shown in FIG. 5), and any other transition portion can define a radius. For example and without limitation, the transition portion 419 (shown in FIG. 4) can define a radius R419 (shown in FIG. 4). In some aspects, a portion of the second engagement portion 240 can be understood as extending from the base 210 in a direction opposite from the direction 203. More specifically, a portion of the second engagement portion 240 can protrude or extend from the second side 212 and, more specifically, the second side surface 214 of the base 210. At least a portion of the second side 212 and, more specifically, the second side surface 214 can be planar.

Figure 4:
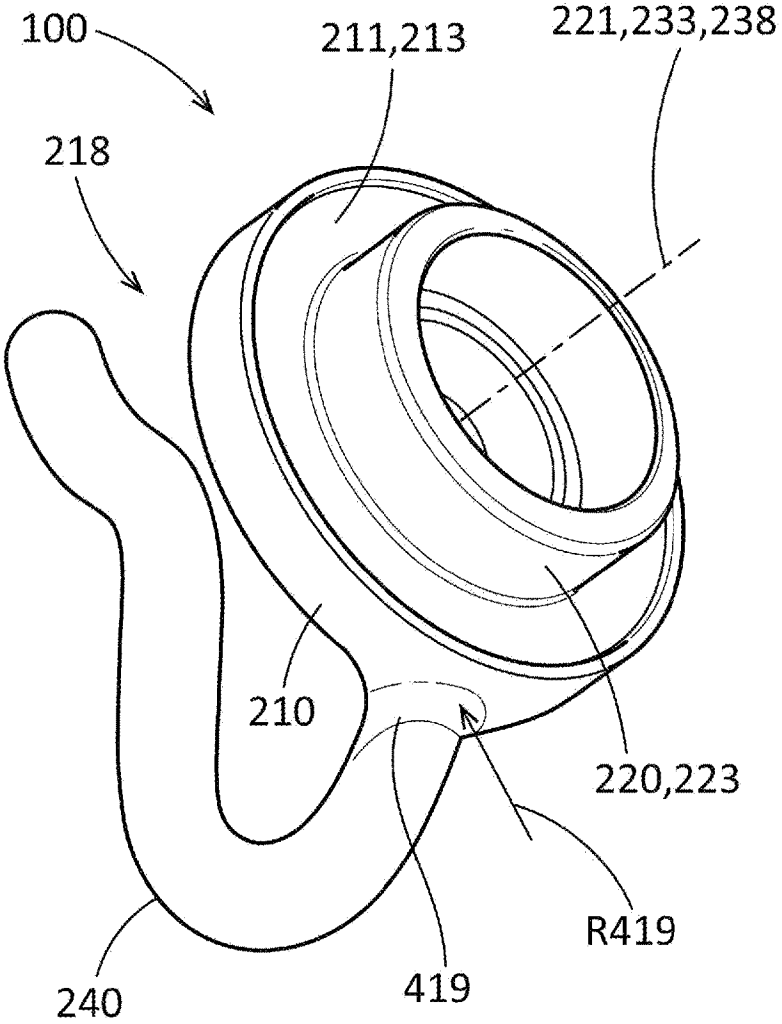
FIG. 4 is a bottom rear perspective view of the first portion of the fastener of FIG. 1.
Figure 3:
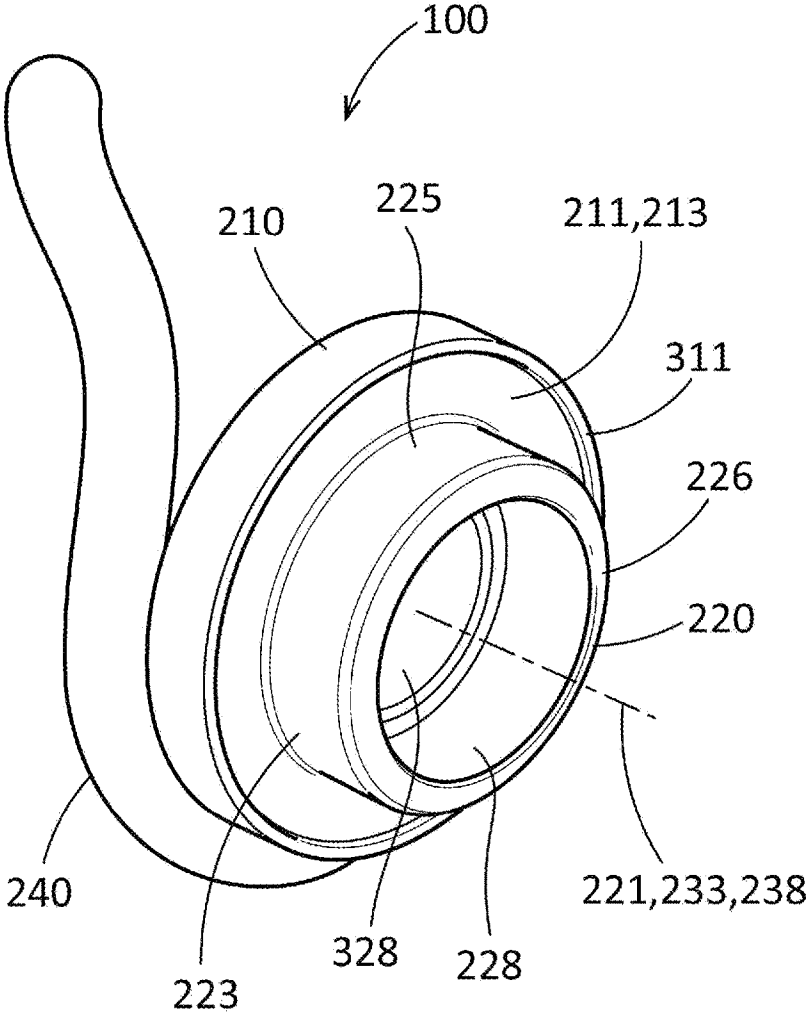
FIG. 3 is a top rear perspective view of the first portion of the fastener of FIG. 1.

FIG. 3 is a top rear perspective view and FIG. 4 is a bottom rear perspective view of the first portion or snap member 100 of the fastener 90 of FIG. 1. As shown, a portion of the first side 211 and, more specifically, the first side surface 213 can define a flange 311, which can extend in an axial direction beyond a surrounding portion of the first side 211 by a flange height or distance 611 (shown in FIG. 6). In some aspects, the flange 311 can facilitate a secure connection and seal between the snap member 100 and the mating snap member 700. In some aspects, the flange 311 can prevent or reduce rotation of the second engagement portion 240 with respect to the base 210, including when the snap member 100 is carrying a load. More specifically, the flange 311 can prevent or reduce such rotation or, more generally, movement with respect to the base 210 by closing or reducing any gap between the second engagement portion 240 and the base 210. The cavity 228 can define a bottom surface 328.

Figure 5:
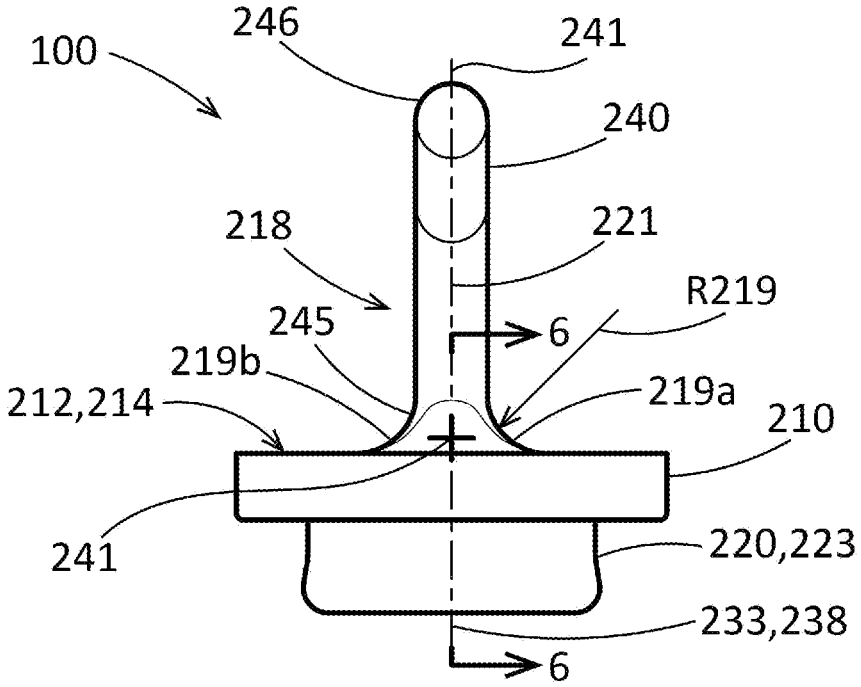
FIG. 5 is a top view of the first portion of the fastener of FIG. 1.

FIG. 5 is a top view of the first portion or snap member 100 of the fastener 90 of FIG. 1. As shown, the axis 241 can be aligned in the same plane as (i.e., can be coplanar with) the axis 233 and/or the axis 238. In alignment with both the axis 233 and the axis 238, a load born by the second engagement portion 240 can be born equally by each left and right side of the first engagement portion 220, which can facilitate continued engagement of the first engagement portion 220 and, more generally, the snap member 100 with the mating snap member 700. In some aspects, the proximal or first end 245 can be a portion of the snap member 100 that protrudes from the base 210 and, more specifically, the second side 212 and second side surface 214 thereof, which again can be planar, substantially planar, or substantially flat. "Substantially planar" means having an overall surface that is planar, ignoring local interruptions to that overall shape, e.g., textural features. "Substantially flat" means having an overall surface that is featureless, ignoring local interruptions to that overall shape, e.g., textural features, and not requiring that the overall surface be planar and, rather, allowing the second side 212 and the second side surface 214 to define, for example and without limitation, a convex or a concave shape).

Figure 6:
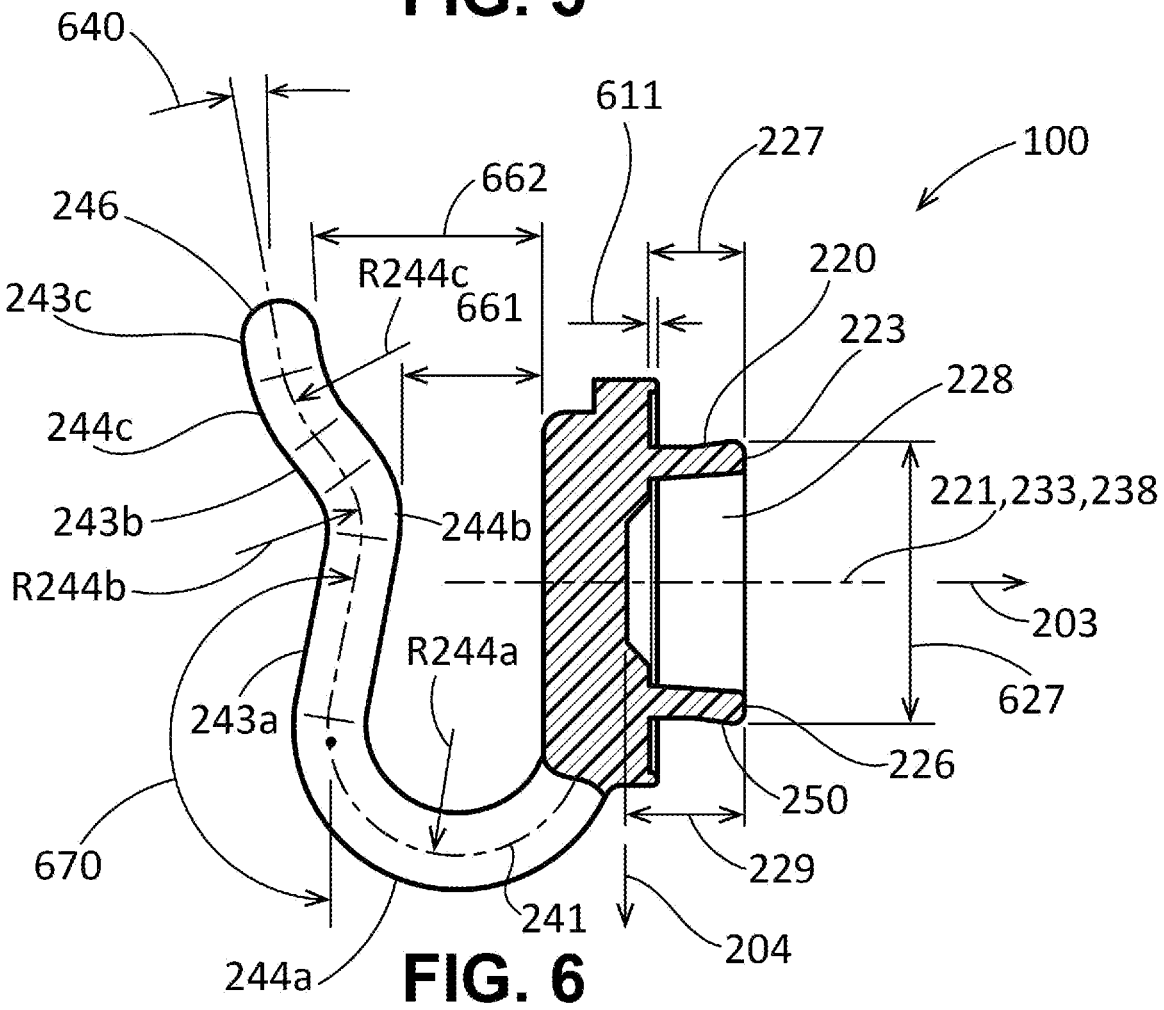
FIG. 6 is a partial sectional view of the first portion of the fastener of FIG. 1 taken along line 6-6 of FIG. 5.

FIG. 6 is a partial sectional view of the first portion or snap member 100 of the fastener 90 of FIG. 1 taken along line 6-6 of FIG. 5. Again, the first engagement portion 220 can comprise the protrusion 223 defining the axial height 227 and the cavity 228 defined therein and defining the axial depth 229. As shown, the axis 241 at the curved portions 244*a,b,c* can define respective radii R244*a,b,c*. In some aspects, the second engagement portion 240 and, more generally, the snap member 100 can define a minimum open width 661 and a maximum open width 662 in a Y-axis direction (shown in FIG. 2). In some aspects, a portion of the second engagement portion 240 such as the straight portion 243*c* can be angled with respect to the vertical by a tilt angle 640 and, more specifically, can be angled with respect to the down vertical direction or the second direction 204. A tilt angle 640 that results from an axis or a tangent line of the distal or second end 246 of the second engagement portion 240 being angled towards the user when the user faces the second side 212 of the snap member 100, as shown, can facilitate engagement of the lower section 80 with each of the fasteners 90 (shown in FIG. 1).

In some aspects, as shown, the hook or hook shape can comprise at least one member defining a tangent line or axis 241 that is angled by a hook angle 670 measuring at least 90 degrees with respect to the downward vertical direction (or an upward vertical direction, if the gap 218 is viewable from below the snap member instead of above the snap member when installed), the vertical direction, and/or the second direction 204. In some aspects, as shown, the hook angle 670 of the tangent line or axis 641 of at least member of the second engagement portion 240 can be at least 180 degrees with respect to the downward vertical direction, the vertical direction, and/or the second direction 204. The hook angle 670 is shown only for the first straight portion 243*a*, but a hook angle can be similarly drawn and measured between, on a first end, the downward vertical direction, the vertical direction, and/or the second direction 204 and, on a second end, the axis 241—or a tangent line either of the axis 241 or else defined by the straight portion 243*a,b,c* or curved portion 244*a,b,c* itself. In some aspects, including when the portion of the second engagement portion 240 is angled with respect to the vertical by a tilt angle 640, the hook angle 670 can measure more than 90 degrees and less than 180 degrees. If, in other aspects, the hook angle 670 is measured from a horizontal line extending from the base 210 towards the second engagement portion 240, the hook angle 670 can measure at least zero degrees with respect to such a horizontal direction, can measure at least 90 degrees with respect to such a horizontal direction, or can measure more than zero degrees and less than 90 degrees. In some aspects, the hook angle 670 as measured to at least one member of the second engagement portion can be as described herein.

In some aspects, as shown, the second engagement portion 240 can, together with the base 210 and/or the first engagement portion 220, form a monolithic or one-piece structure therewith. In some aspects, the second engagement portion 240 can be formed separately and can be attached to the base 210 and, more generally, a remaining portion of the snap member 100. More specifically, the second engagement portion 240 can be fastened or secured to the base 210.

Figure 7:
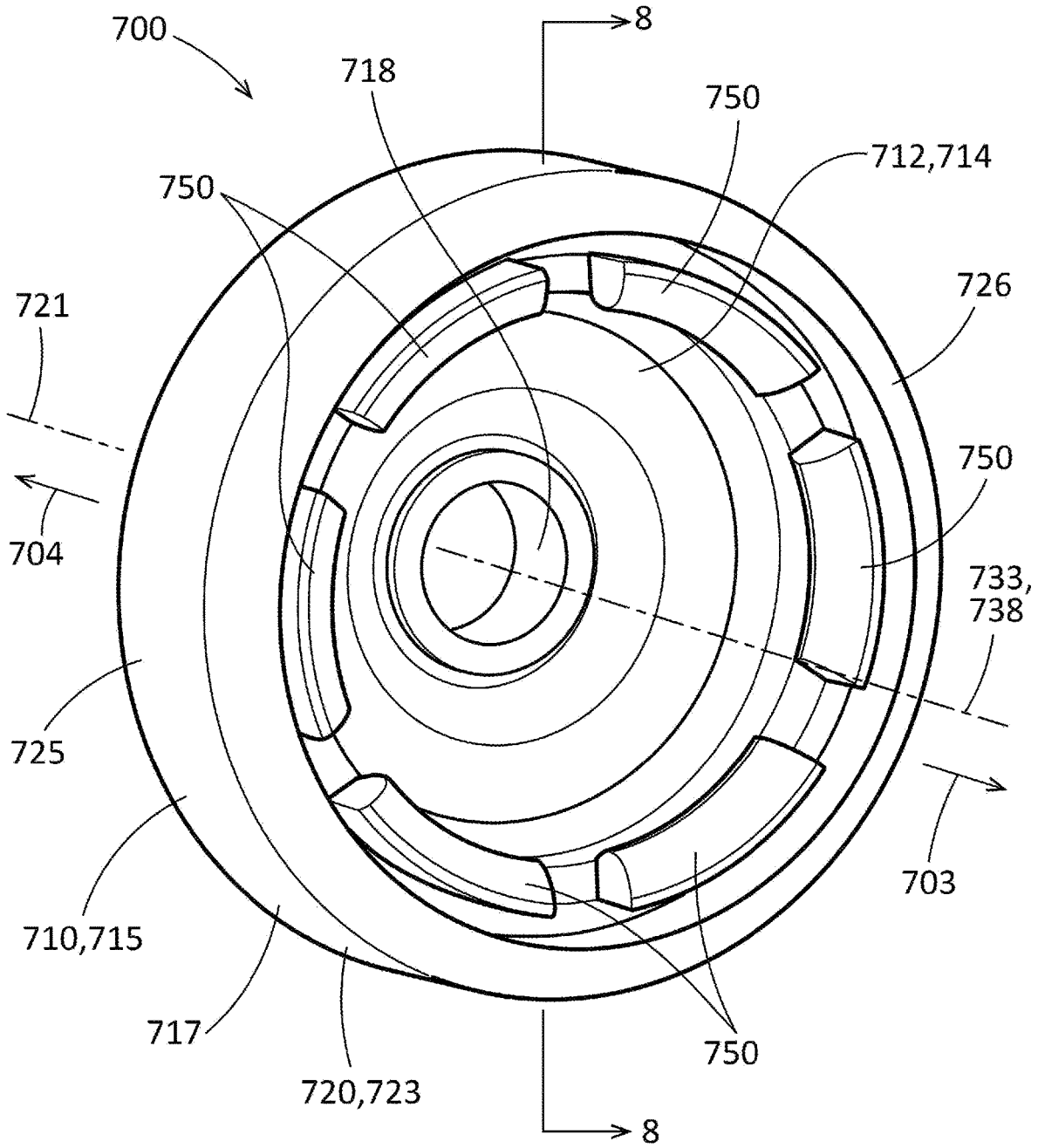
FIG. 7 is a front perspective view of a second portion or mating snap member of the fastener of FIG. 1, the second portion configured to be received within or, as shown, to receive the first portion.
Figure 8:
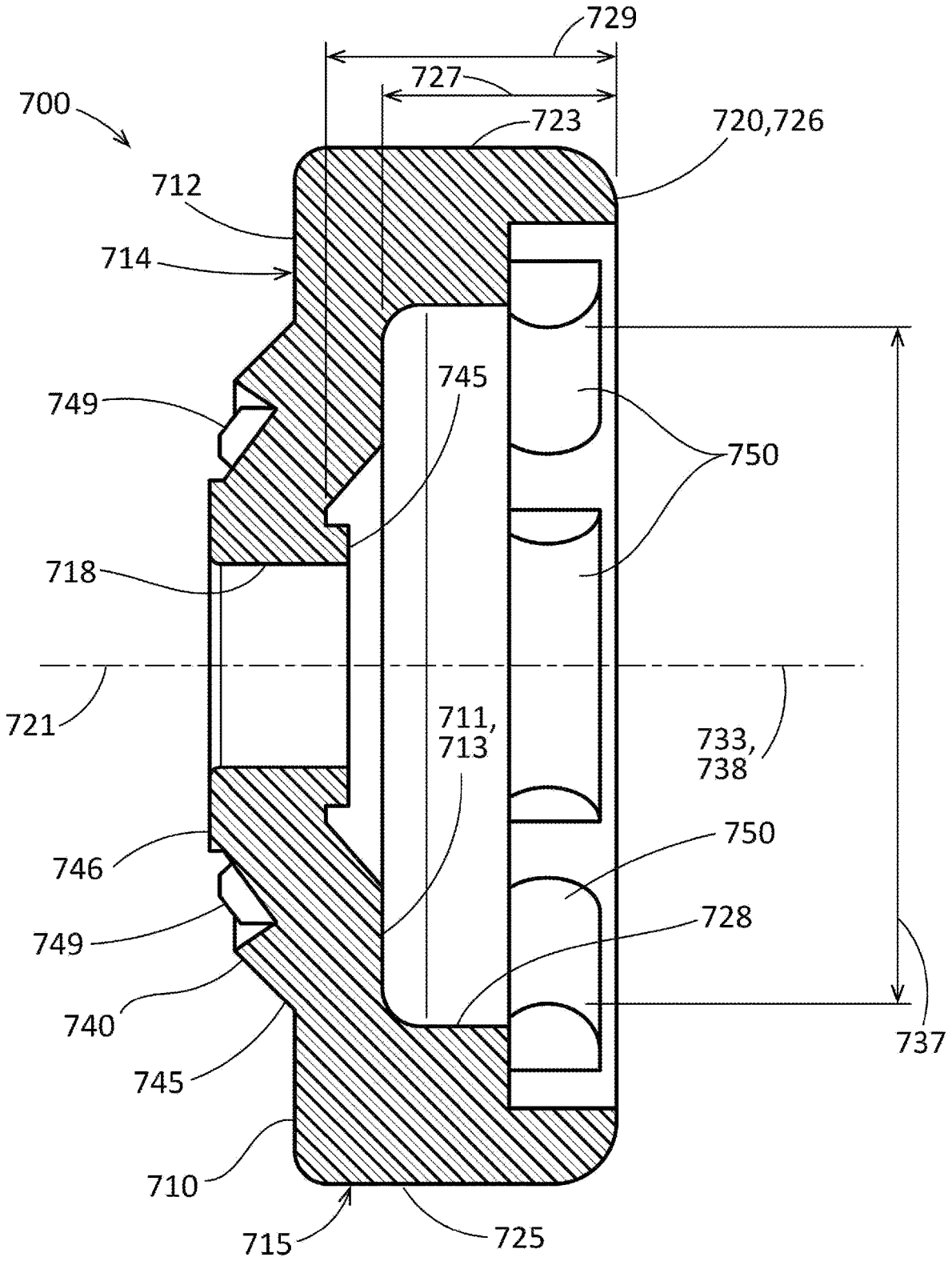
FIG. 8 is a sectional view of the second portion of FIG. 7 taken along line 8-8 of FIG. 7.
Figure 11:
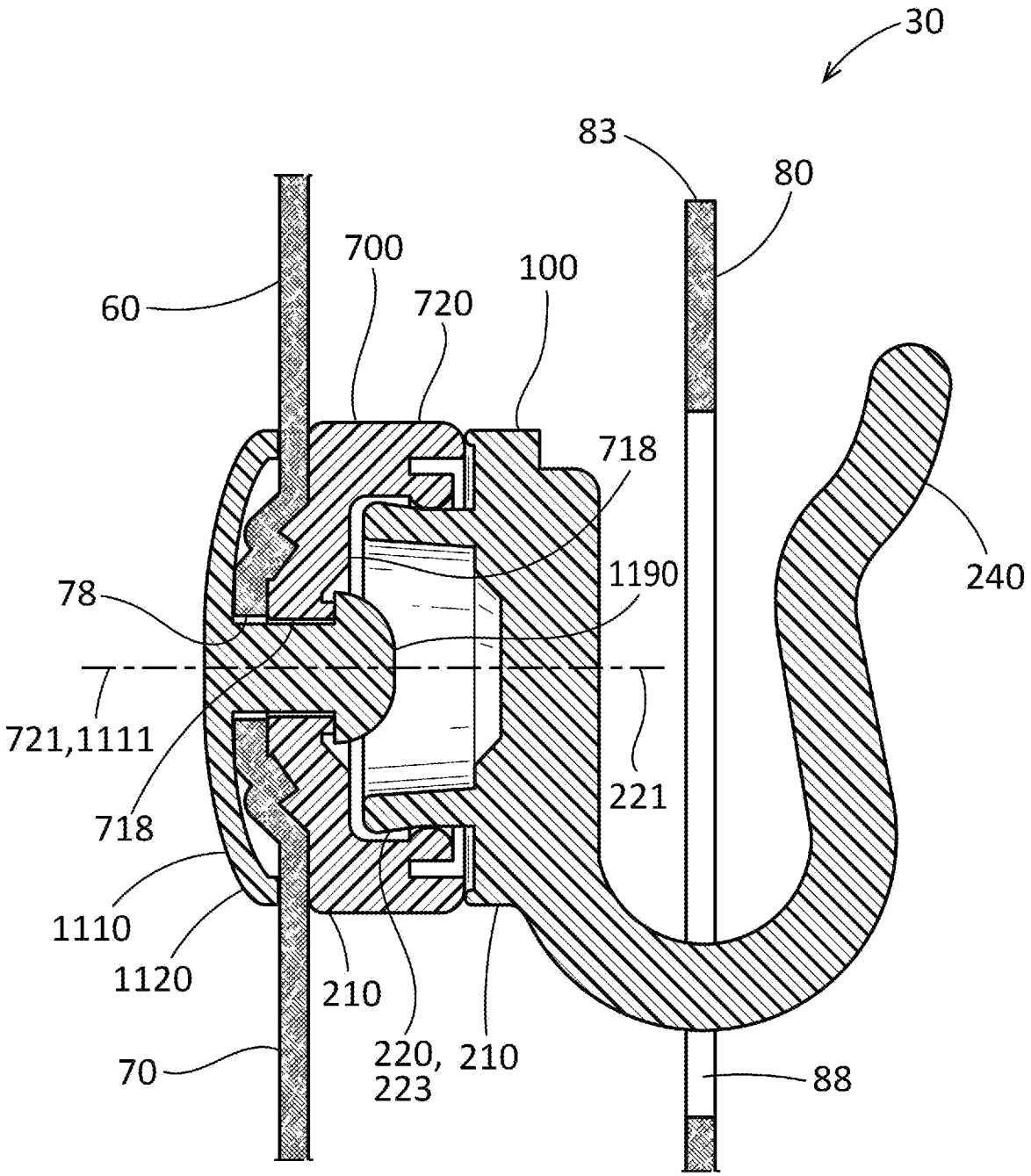
FIG. 11 is a sectional view of the assembly of FIG. 9 taken along line 11-11 of FIG. 10 and showing also the lower section of FIG. 1 as it is being placed over the fastener and, more specifically, the first portion thereof.

FIG. 7 is a front perspective view of the second portion or mating snap member 700 of the fastener 90 of FIG. 1, and FIG. 8 is a sectional view of the second portion or mating snap member 700 of FIG. 7 taken along line 8-8 of FIG. 7. The second portion 700 can be configured to be received within or, as shown in FIG. 11, can be configured to receive the first portion or snap member 100. The mating snap member 700 can comprise a base 710. The base 710 can define a first side 711 (shown in FIG. 8), which can define a first side surface 713 (shown in FIG. 8). The base 710 can define a second side 712, which can define a second side surface 714. The base 710 can define an outer edge 715, which can define an outer edge surface 717 and can be cylindrical or substantially cylindrical in shape ("substantially cylindrical" meaning having an overall shape that is cylindrical, ignoring local interruptions to that overall shape that do no extend around the full circumference of the outer edge 715 as well as draft angles of five degrees or less that facilitate manufacturability of the mating snap member 700). In some aspects, as shown, the base 710 can define a disc shape. More specifically, the base 710 can define a circular shape in cross-section and, more specifically, in radial cross-section, where a radial cross-section lies in a viewing plane that is perpendicular to an axis 721 of the mating snap member 700. In some aspects, the base 710 can define a non-disc shape or a non-circular shape in cross-section and, more specifically, in radial cross-section.

The mating snap member 700 can comprise a first engagement portion 720, which can extend from the base 710 in a first direction 703. The first direction 703 can be aligned with the axis 721 of the mating snap member 700. More specifically, the mating snap member 700 can be configured to engage with a first engagement portion 220 (shown in FIG. 6) of the snap member 100 (shown in FIG. 7). The first engagement portion 720 can comprise a protrusion 723, which can define a proximal or first end 725 and a distal or second end 726. More specifically, the protrusion 723 can define an axial height 727 (shown in FIG. 8). The first engagement portion 720 can define a cavity 728, which can be defined in the protrusion 223. More specifically, the cavity 728 can define an axial depth 729 (shown in FIG. 8). An axis 733 of the protrusion 723 and an axis 738 of the cavity 728 can be collinear. In some aspects, the first engagement portion 720 can define rotational symmetry about the axis 721. At least a portion of the first side 711 and, more specifically, the second side surface 713 can be planar.

Defined in further detail below, an inner diameter 737 (shown in FIG. 8) of the first engagement portion 720 at the second end 726 can be smaller than the inner diameter 737 when measured at the first end 725. In some aspects, a minimum value of an inner diameter 737 of the first engagement portion 720 can be configured to increase during assembly of the first engagement portion 720 with the first engagement portion 220 of the snap member 100 to allow and facilitate insertion in and locking engagement of the first engagement portion 220 with the first engagement portion 720. As shown, the first engagement portion 720 can define one or more bulbous tips or ribs 750 at the second end 226, which can further facilitate locking engagement of the first engagement portion 220 with the first engagement portion 720. More specifically, the one or more ribs 750 can interact or engage with the one or more ribs 250 of the first engagement portion 220 to hold the snap member 100 to the mating snap member 700 until purposely disengaged by a user with a sufficient separation force. In some aspects, also as shown, a plurality of the ribs 750 can extend circumferentially around the cavity 728, and adjacent ribs 750 can define a gap therebetween to allow the ribs to ribs 750 to more easily flex upon engagement with the snap member 100.

The mating snap member 700 can comprise a second engagement portion 740, a portion of which can extend from the base 710 in a second direction 704 or can be considered part of the base 710. In some aspects, as shown, the second direction 704 can be aligned with the axis 721 of the mating snap member 700 and/or the first direction 703. In some aspects, the second direction 704 can be angled with respect to the axis 721 of the mating snap member 700 and/or the first direction 703. The second engagement portion 740 can define a proximal or first end 745 and a distal or second end 746. The second engagement portion 740 can comprise one or more anti-rotation features 749, which can facilitate fixation of an angular position of the mating snap member 700 with respect to an object such as, for example and without limitation, the curtain 60 (shown in FIG. 1) through which the mating snap member 700 can be secured. The mating snap member 700 and, more specifically, the base 710 and/or one or more other portions of the mating snap member 700 can define an opening 718 for passage of fastening structure 1110 (shown in FIG. 11), which can also extend through an object such as a portion of the upper section 70 of the curtain 60 proximate to the bottom end 74. At least a portion of the second side 712 and, more specifically, the second side surface 714 can be planar.

Figure 9:
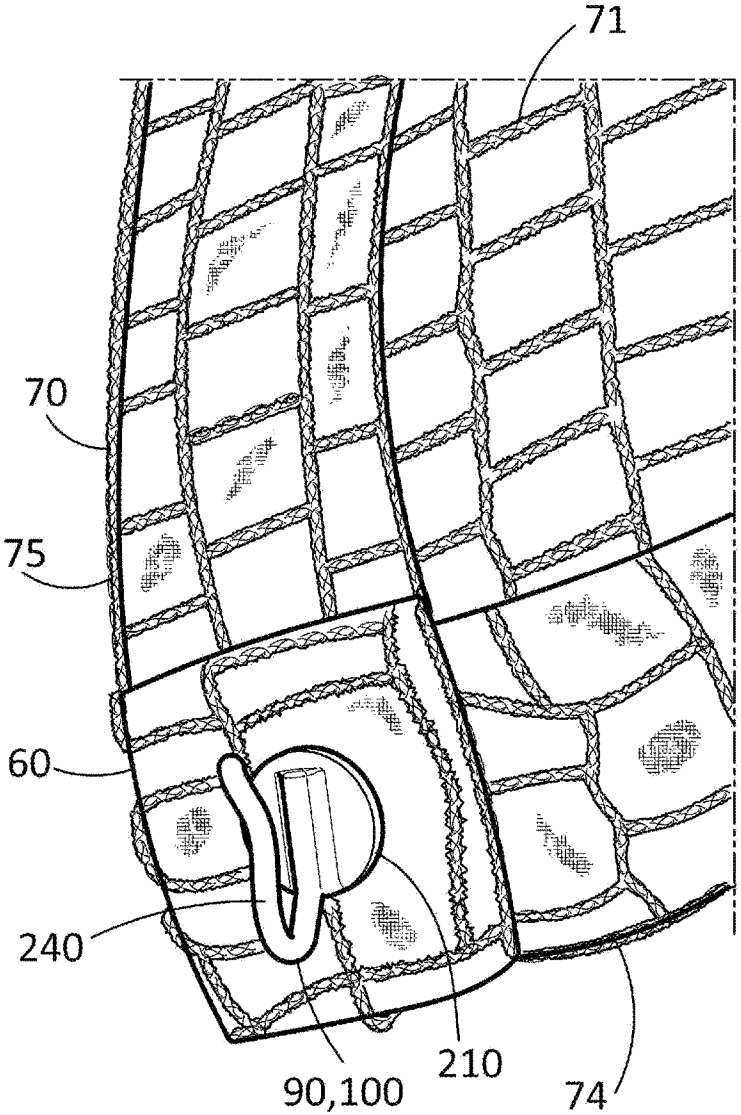
FIG. 9 is a front perspective view of an assembly comprising the upper section of FIG. 1 and the first portion of the fastener of FIG. 1 secured to the upper section.

FIG. 9 is a front perspective view of the upper section 70 of the curtain 60 of FIG. 1 with the first portion or snap member 100 of the fastener 90 of FIG. 1 secured thereto. In some aspects, as shown, the fastener 90 can be positioned proximate to an intersection of the lower end 74 and the first side end 75 of the upper section 70 of the curtain 60. In some aspects, the fastener 90 can be positioned at any desired position along the curtain and, more specifically, the upper section 70 thereof. In some aspects, the snap member 100 and the mating snap member 700 can be specified and installed together.

In some aspects, the snap member 100 can be sized and otherwise configured to install in pre-existing mating snap member 700 and thus enabling re-use of an existing upper section 70. Given the number of curtains 60 in some facilities, the cost of replacement, and the consideration that the lower sections 80 of the curtain 60 are most vulnerable to soiling and wear due to cleaning, it can be particularly advantageous to be able to hang a pre-punched curtain (i.e., punched with the openings 88) onto an existing hospital privacy curtain (e.g., the upper section 70) and not be limited to products made specifically to fit with the included hardware, whether snap or otherwise. In some aspects, each of the first portion 100 and the second portion 700 of the fastener 90 need not be snap members and need not form a snap fastener. For example and without limitation, the first portion 100 and the second portion 700 can be joined via a magnetized connection using, for example and without limitation, a magnet in one of the first portion 100 and the second portion 700 and a second disc magnet or simply a magnetic material in the other of the first portion 100 and the second portion 700. With the snap fasteners 90, however, a user (e.g., an employee responsible for handling the cleaning of the curtains 60 in the facility) can simply hang the lower section 80 from an existing snap socket or mating snap member 700 through the snap member 100. Without needing to engage or disengage any snapped connections, taking significantly more time and energy, the user can hang and take down the curtain 60 by simply lifting the top end 83 over the second engagement portions 240 of the snap member 100 to install or remove. Improved ease of attachment and removal of the lower section 80 not only reduces the difficulty of the work but increases safety. If the user decides to access the connection between the lower section 80 and the upper section 70 via a step stool or ladder, for example, the user can spend less time on the ladder and exert less force, thereby reducing the risk that they might in the process fall from the ladder.

Figure 10:
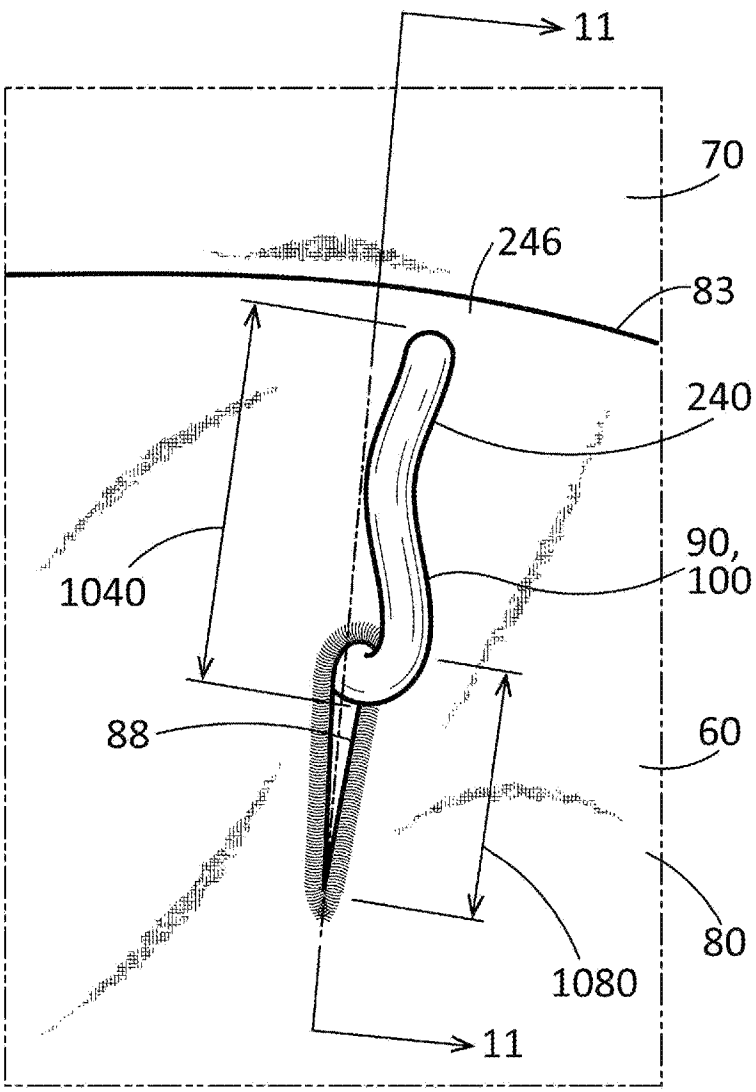
FIG. 10 is a front perspective view of the lower section of FIG. 1 engaged with and suspended from the first portion of the fastener of FIG. 1.

FIG. 10 is a front perspective view of the lower section 80 of the curtain 60 of FIG. 1 engaged with and suspended from the first portion or snap member 100 of the fastener 90 of FIG. 1, which again is secured to the upper section 70 of the curtain 60. In some aspects, as shown, the second engagement portion 240 of each of the one or more fasteners 90 can be removably received—and securably received—within one of a plurality of openings 88 defined in the lower section 80 of the curtain 60. In some aspects, the components of the fastener 90 can be rearranged in various ways. For example and without limitation, the mating snap member 700 can be secured to the lower section 80, the snap member 100 can be engaged with the second engagement portion 240, and with the distal end 246 of the second engagement portion 240 pointing downward instead of upward the second engagement portion 240 can be received within the openings 88 when defined along and proximate to a lower end 74 of the upper section 70. In some aspects, a height 1040 of the second engagement portion 240 can be greater than a height 1080 of the opening 88 to help secure the lower section 80 to the one or more fasteners 90. In some aspects, a height 1040 of the second engagement portion 240 can be less than a height 1080 of the opening 88 to ease removal and reinstallation of the lower section 80.

FIG. 11 is a sectional view of the assembly of FIG. 9 and, more generally, the system 30 showing also the lower section 80 of FIG. 1 as it is being placed over the fastener 90 and, more specifically, the first portion or snap member 100 thereof. The mating snap member 700 can be secured to the curtain 60 and, more specifically, the upper section 70, be assembling the fastening member or fastening structure 1110 (e.g., a button 1120 comprising a stud 1190) along an axis 1111. More specifically, the fastening structure 1110 can be passed, at least in part, through an opening 78 defined in the upper section 70, and the stud 1190, which can be a rivet, can be deformed or otherwise made to engage with the mating snap member 700 and thereby secure the mating snap member 700 to the curtain 60.

Again, as shown, each of or any of a plurality of the second portions or mating snap members 700 can be secured to the upper section 70, and each of or any of a plurality of the first portions or snap members 100 can be removably secured to one of the second portions or mating snap members 700. More specifically, a second engagement portion 240 of each of one of the plurality of fasteners 90 (e.g., the hook portion of the snap member 100) can be removably inserted in one of the plurality of openings 88 defined in the lower section 80. In some aspects, each of or any of a plurality of the second portions or mating snap members 700 can be secured to the lower section 80, and each of or any of a plurality of the first portions or snap members 100 can be removably secured to one of the second portions or mating snap members 700.

In some aspects, the first engagement portion 220 can comprise one of a male engagement portion or stud, as shown, and a female engagement portion or socket; and the first engagement portion 720 of the mating snap member 700 can comprise one of the female engagement portion and the male engagement portion. More specifically, as shown, the first engagement portion 220 can comprise the male engagement portion; and the mating snap member 700 can comprise the female engagement portion.

A method of using the snap member 100 can comprise removably securing the first engagement portion 220 of the snap member 100 to a first object. More specifically, the method can comprise removably securing the snap member 100 to one of the upper section 70 and a lower section 80 of the curtain 60. The method can comprise removably receiving the second engagement portion 240 of the snap member 100 within the opening 88 defined in a second object. More specifically, the method can comprise removably securing the other of the upper section 70 and the lower section 80 to the snap member 100. The method can comprise disengaging the second object from the snap member 100 without removing the snap member 100 from the first object. More specifically, the method can comprise disengaging the other of the upper section 70 and the lower section 80 from the snap member 100 without removing the snap member 100 from the one of an upper section 70 and the lower section 80 of the curtain 60.

In some aspects, various components of the fastener 90 can be formed from or comprise a metal such as, for example and without limitation, carbon steel, stainless steel, or brass. In some aspects, various components of the fastener 90 can be formed from or comprise a non-material material such as, for example and without limitation, a plastic resin, e.g., a polyacetal resin. More specifically, a portion of the fastener 90 such as the snap member 100 can be formed from polyacetal. In some aspects, the various components can be formed from any other material, any of which can optionally be corrosion-resistant or replaceable for serviceability. In some aspects, the various components of the fastener 90 can be formed from different materials. For example and without limitation, the mating snap member 700 and the fastening structure 1110 can be formed from metal and the snap member can be formed from plastic. The various components of the fastener 90 can be formed from any one or more of a variety of manufacturing processes. For example and without limitation, one or more components can be fabricated using subtractive manufacturing processes such as machining, forging, casting, stamping; additive manufacturing processes such as three dimensional printing; and any other forming and assembly processes such as bending and riveting.

One should note that conditional language, such as, among others, "can," "could," "might," or "may," unless expressly stated otherwise, or otherwise understood within the context as used, is generally intended to convey that certain aspects include, while other aspects do not include, certain features, elements, and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Many variations and modifications may be made to the above-described aspect(s) without departing substantially from the spirit and principles of the present disclosure. Further, the scope of the present disclosure is intended to cover any combinations and sub-combinations of all elements, features, and aspects discussed above. All such modifications and variations are intended to be included within the scope of the present disclosure, and all possible claims to individual aspects or combinations of elements or steps are intended to be supported by the present disclosure.

That which is claimed is:

1. A snap member of a fastener, the snap member comprising:

a base;

a first engagement portion extending from the base and configured to engage with a first engagement portion of a mating snap member, the first engagement portion of the snap member comprising a protrusion defining an axial height, the first engagement portion of the snap member defining a cavity in the protrusion defining an axial depth, the first engagement portion of the snap member defining a first end proximate to the base and a second end distal from the base, an outer diameter of the first engagement portion of the snap member at the second end being larger than the outer diameter of the first engagement portion of the snap member at the first end; and a second engagement portion extending from the base, the second engagement portion defining a hook shape.

2. The snap member of claim 1, wherein:

the first engagement portion of the snap member comprises one of a male engagement portion and a female engagement portion; and the first engagement portion of the mating snap member comprises one of a female engagement portion and a male engagement portion.

3. The snap member of claim 2, wherein:

the first engagement portion of the snap member comprises the male engagement portion of the first engagement portion of the snap member; and the first engagement portion of the mating snap member comprises the female engagement portion of the first engagement portion of the mating snap member.

4. The snap member of claim 1, wherein a maximum value of the outer diameter of the first engagement portion of the snap member at the second end of the first engagement portion of the snap member is configured to decrease during assembly of the first engagement portion of the snap member with the first engagement portion of the mating snap member.

5. The snap member of claim 1, defining a gap configured to receive a portion of an object therebetween, the second engagement portion configured to be securably and removably received within an opening defined in the object.

6. The snap member of claim 1, wherein:

the first engagement portion of the snap member extends from the base in a first direction; and the second engagement portion extends from the base in a second direction, the second direction being angled with respect to the first direction.

7. The snap member of claim 1, wherein the second engagement portion comprises at least one of a curved portion and a straight portion.

8. The snap member of claim 7, wherein the at least one of the curved portion and the straight portion defines a hook angle measuring at least 90 degrees with respect to a vertical direction of the snap member.

9. The snap member of claim 1, wherein a distal end of the second engagement portion is angled towards a user when the user faces a second side of the snap member, the second side facing opposite from a direction in which the first engagement portion of the snap member extends.

10. The snap member of claim 1, wherein the snap member is a monolithic structure.

11. The snap member of claim 1, wherein a radial cross section of the first engagement portion of the snap member defines a circular shape.

12. A curtain comprising:

at least one of an upper panel and a lower panel; and the snap member of claim 1, the snap member configured to engage with the at least one of an upper panel and a lower panel.

13. The curtain of claim 12, wherein the snap member is a first snap member, the curtain further comprising a second snap member spaced apart from the first snap member and comprising:

a base;

a first engagement portion extending from the base of the second snap member and configured to engage with a first engagement portion of a second mating snap member, the first engagement portion of the second snap member comprising a protrusion defining an axial height, the first engagement portion of the second snap member defining a cavity in the protrusion of the second snap member defining an axial depth; and a second engagement portion extending from the base of the second snap member, the second engagement portion of the second snap member defining a hook shape.

14. The curtain of claim 13, wherein the second snap member is spaced apart from the first snap member in a direction parallel to a top end of the curtain.

15. The curtain of claim 12, further comprising a plurality of snap members comprising the snap member.

16. The curtain of claim 12, comprising each of the upper panel and the lower panel.

17. The curtain of claim 16, further comprising:

a plurality of snap members comprising the snap member; and a plurality of mating snap members comprising the mating snap member, each of the plurality of mating snap members configured to securably engage with a snap member of the plurality of snap members.

18. The curtain of claim 17, wherein adjacent snap members of the plurality of snap members define a common horizontal spacing therebetween.

19. The snap member of claim 1, wherein the first engagement portion of the snap member defines rotational symmetry about an axis thereof.

20. The snap member of claim 1, wherein the second engagement portion comprises a curved portion defining the hook shape, the curved portion defining an axis, the axis defining a radius beginning from a point positioned radially inward from an outer edge of the base.

21. The snap member of claim 1, wherein the base defines a first side and a second side facing in an opposite axial direction from the first side, the first side defining a flange extending in an axial direction beyond a remaining portion of the first side by a flange height.

22. The snap member of claim 1, wherein the second engagement portion comprises a plurality of nonconcentric curved portions.

23. A snap member of a fastener, the snap member comprising:

a base;

a first engagement portion extending from the base and configured to engage with a first engagement portion of a mating snap member, the first engagement portion of the snap member comprising a protrusion defining an axial height, the first engagement portion of the snap member defining a cavity in the protrusion defining an axial depth, the first engagement portion of the snap member comprising a male engagement portion and the first engagement portion of the mating snap member comprising a female engagement portion; and a second engagement portion extending from the base, the second engagement portion defining a hook shape.

24. A snap member of a fastener, the snap member comprising:

a base;

a first engagement portion extending from the base and configured to engage with a first engagement portion of a mating snap member, the first engagement portion of the snap member comprising a protrusion defining an axial height, the first engagement portion of the snap member defining a cavity in the protrusion defining an axial depth; and a second engagement portion extending from the base, the second engagement portion defining a hook shape;

wherein the snap member is a monolithic structure.

25. A snap member of a fastener, the snap member comprising:

a base;

a first engagement portion extending from the base and configured to engage with a first engagement portion of a mating snap member, the first engagement portion of the snap member comprising a protrusion defining an axial height, the first engagement portion of the snap member defining a cavity in the protrusion defining an axial depth; and a second engagement portion extending from the base, the second engagement portion defining a hook shape;

wherein a radial cross section of the first engagement portion of the snap member defines a circular shape.

* * * * *